US012108893B1

(12) United States Patent
Jones

(10) Patent No.: US 12,108,893 B1
(45) Date of Patent: Oct. 8, 2024

(54) REMOTE-CONTROLLED COLLAPSIBLE VALET STAND

(71) Applicant: Brian Jones, Dallas, TX (US)

(72) Inventor: Brian Jones, Dallas, TX (US)

( * ) Notice: Subject to any disclaimer, the term of this patent is extended or adjusted under 35 U.S.C. 154(b) by 0 days.

(21) Appl. No.: 18/601,731

(22) Filed: Mar. 11, 2024

(51) Int. Cl.
*A47G 25/06* (2006.01)
*A47G 25/90* (2006.01)

(52) U.S. Cl.
CPC ..... *A47G 25/0671* (2013.01); *A47G 25/90* (2013.01)

(58) Field of Classification Search
CPC ..... A47G 25/0671; A47G 25/0685; A47G 25/90; A47B 81/00; D06F 57/04; D06F 57/06; D06F 57/08
See application file for complete search history.

(56) References Cited

U.S. PATENT DOCUMENTS 612,623 A * 10/1898 Benesh ..... A47G 25/905 211/4
624,848 A * 5/1899 McCausland ..... A47G 25/90 211/1
1,075,395 A * 10/1913 Beegle ..... A47G 25/0664 211/196
2,811,293 A * 10/1957 Holm ..... A47G 25/90 211/1
4,892,239 A * 1/1990 Tomasi ..... A47G 25/90 223/111
5,501,376 A * 3/1996 Roda-Balzarini ..... A47G 25/90 223/111
7,530,543 B1 * 5/2009 Kremzar ..... A47B 97/02 248/188.7
8,418,860 B2 * 4/2013 Rimmer ..... D06F 57/04 211/85.3
8,608,022 B1 * 12/2013 Kory ..... A47G 25/90 221/33
8,674,330 B2 * 3/2014 Beck ..... A47B 83/00 250/516.1
9,833,892 B1 * 12/2017 Gomez ..... B25H 1/12
9,909,250 B1 * 3/2018 Greenspon ..... A47G 25/0685
10,111,543 B2 * 10/2018 Terragni ..... A47G 25/0685
10,333,320 B2 * 6/2019 Salinas Ruiz ..... H02J 7/0013
11,793,251 B2 * 10/2023 Holalakere Sreenivasa ..... A41D 13/129
11,950,690 B2 * 4/2024 Wiedeman ..... A47B 3/06
(Continued)

*Primary Examiner* — Ko H Chan
(74) *Attorney, Agent, or Firm* — Pharar Patents & Intellectual Property; Andrew A. Pharar

(57) ABSTRACT

The remote-controlled collapsible valet stand may assist a user in wearing an article of clothing without needing to reach behind themselves to grasp the clothing. The device may comprise a linear actuator mounted to a base and raising a plurality of arms to dress the user. The device may be remote controlled, and the user of the device may place an article of clothing onto the arms and then control the height of the actuator to have the clothing lifted onto their person for easy wearing. The remote-controlled collapsible valet stand may further comprise a plurality of clips allowing the clothing to be quickly disconnected once the user is wearing it, and height adjustability so that users of varying heights may be able to use the device. In one embodiment the device may comprise a plurality of cowlings, near field communication, audible and visual alerts, proximity sensors, and various attachments considered related in the art.

12 Claims, 19 Drawing Sheets

(56) References Cited

U.S. PATENT DOCUMENTS

| | | | | |
|---|---|---|---|---|
| 2013/0333595 | A1* | 12/2013 | Cotey | A47B 13/023 108/150 |
| 2014/0297487 | A1* | 10/2014 | Bashkin | H04N 23/90 705/28 |
| 2018/0192805 | A1* | 7/2018 | Terragni | A47B 61/02 |
| 2019/0375343 | A1* | 12/2019 | Erdtmann | A47B 43/00 |
| 2022/0369840 | A1* | 11/2022 | Li | A47G 25/90 |
| 2023/0148749 | A1* | 5/2023 | Sevadjian | B25H 3/00 312/107 |

* cited by examiner

REMOTE-CONTROLLED COLLAPSIBLE VALET STAND

TECHNICAL FIELD OF THE INVENTION

The present invention relates in general to clothing stands, and, more specifically, to a remote-controlled collapsible valet stand.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Clothing stands, also known as valet stands, have been traditionally utilized in homes, offices, and public spaces to provide a convenient storage solution for coats, hats, scarves, and other garments. Conventional clothing stands typically consist of a central pole with hooks or pegs attached to it, providing a simple and accessible means of hanging garments. Variations of the clothing stand have been designed to include adjustable hooks or hangers that can be repositioned along the central pole to accommodate different garment sizes and shapes securely. The adjustable hooks may feature locking mechanisms or frictional engagement elements to ensure stability and prevent slippage. Traditional clothing stands though, being designed for storage, do not provide a means for assisting a user with wearing a an article of clothing.

For individuals with mobility impairments, performing daily tasks such as dressing can present significant challenges. Conventional dressing aids, such as dressing sticks, have been developed to assist individuals in manipulating clothing items, such as pulling up pants or reaching zippers, buttons, or shoelaces. Traditional dressing sticks typically consist of a long rod with a hook or loop attachment at one end, allowing users to grasp and manipulate clothing items without requiring extensive reaching or bending. While these devices can be helpful, they often lack adaptability and may not effectively address the diverse needs and preferences of users with varying levels of mobility or dexterity.

Such individuals with mobility impairments may have particular difficulty with wearing a coat, button-down shirt, or the like, as the process requires inserting an arm into one sleeve of the article of clothing and then reaching back to insert a second arm into the other sleeve of the article of clothing. Dressing sticks are useful in such situations, as they allow the user to draw the clothing around themselves after inserting a first arm therein. These devices, though, require that the user manipulate the dressing stick to engage clothing they may not be able to see since it is behind them, and the user may not be able to easily engage the article of clothing with the dressing stick. No device exists in the art to assist a user with wearing an article of clothing without reaching behind themselves to engage the clothing.

Thus, there is a need in the art for a remote-controlled collapsible valet stand that may assist a user in wearing an article of clothing without needing to reach behind themselves to grasp the clothing. The device may comprise a linear actuator mounted to a base and raising a plurality of arms to dress the user. The device may be remote controlled, and the user of the device may place an article of clothing onto the arms and then control the height of the actuator to have the clothing lifted onto their person for easy wearing. The remote-controlled collapsible valet stand may further comprise a plurality of clips allowing the clothing to be quickly disconnected once the user is wearing it, and height adjustability so that users of varying heights may be able to use the device. In one embodiment the device may comprise a plurality of cowlings, near field communication, audible and visual alerts, proximity sensors, and various attachments considered related in the art. It is to these ends that the present invention has been developed.

BRIEF SUMMARY OF THE INVENTION

To minimize the limitations in the prior art, and to minimize other limitations that will be apparent upon reading and understanding the present specification, the present invention describes a remote-controlled collapsible valet stand.

It is an objective of the present invention to provide a remote-controlled collapsible valet stand that may comprise a main body.

It is another objective of the present invention to provide a remote-controlled collapsible valet stand that may comprise a lower cowling.

It is another objective of the present invention to provide a remote-controlled collapsible valet stand that may comprise an upper cowling.

It is another objective of the present invention to provide a remote-controlled collapsible valet stand that may comprise a tripod base.

It is another objective of the present invention to provide a remote-controlled collapsible valet stand that may comprise an atlas.

It is another objective of the present invention to provide a remote-controlled collapsible valet stand that may comprise a pivot.

It is another objective of the present invention to provide a remote-controlled collapsible valet stand that may comprise a plurality of arms.

It is another objective of the present invention to provide a remote-controlled collapsible valet stand that may comprise a plurality of clips.

It is another objective of the present invention to provide a remote-controlled collapsible valet stand that may comprise a spring rod.

It is another objective of the present invention to provide a remote-controlled collapsible valet stand that may comprise a remote holder.

It is another objective of the present invention to provide a remote-controlled collapsible valet stand that may comprise a linear actuator.

It is another objective of the present invention to provide a remote-controlled collapsible valet stand that may comprise a remote.

It is another objective of the present invention to provide a remote-controlled collapsible valet stand that may comprise a height adjuster.

It is another objective of the present invention to provide a remote-controlled collapsible valet stand that may comprise a pushrod housing.

It is another objective of the present invention to provide a remote-controlled collapsible valet stand that may comprise a pushrod.

It is another objective of the present invention to provide a remote-controlled collapsible valet stand that may comprise an electric motor.

It is another objective of the present invention to provide a remote-controlled collapsible valet stand that may comprise a proximity sensor.

It is another objective of the present invention to provide a remote-controlled collapsible valet stand that may comprise an audiovisual alarm.

It is another objective of the present invention to provide a remote-controlled collapsible valet stand that may comprise a proprietary software.

It is another objective of the present invention to provide a remote-controlled collapsible valet stand that may comprise a display.

It is another objective of the present invention to provide a remote-controlled collapsible valet stand that may comprise a resilient material of construction.

It is another objective of the present invention to provide a remote-controlled collapsible valet stand that may comprise a water-proof material of construction.

It is another objective of the present invention to provide a remote-controlled collapsible valet stand that may comprise a reusable material of construction.

It is another objective of the present invention to provide a remote-controlled collapsible valet stand that may comprise a washable material of construction.

It is another objective of the present invention to provide a remote-controlled collapsible valet stand that may comprise a multi-component construction.

It is another objective of the present invention to provide a remote-controlled collapsible valet stand that may comprise an antimicrobial layer.

It is another objective of the present invention to provide a remote-controlled collapsible valet stand that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The remote-controlled collapsible valet stand may assist a user in wearing an article of clothing without needing to reach behind themselves to grasp the clothing. The device may comprise a linear actuator mounted to a base and raising a plurality of arms to dress the user. The device may be remote controlled, and the user of the device may place an article of clothing onto the arms and then control the height of the actuator to have the clothing lifted onto their person for easy wearing. The remote-controlled collapsible valet stand may further comprise a plurality of clips allowing the clothing to be quickly disconnected once the user is wearing it, and height adjustability so that users of varying heights may be able to use the device. In one embodiment the device may comprise a plurality of cowlings, near field communication, audible and visual alerts, proximity sensors, and various attachments considered related in the art.

Figure 1:
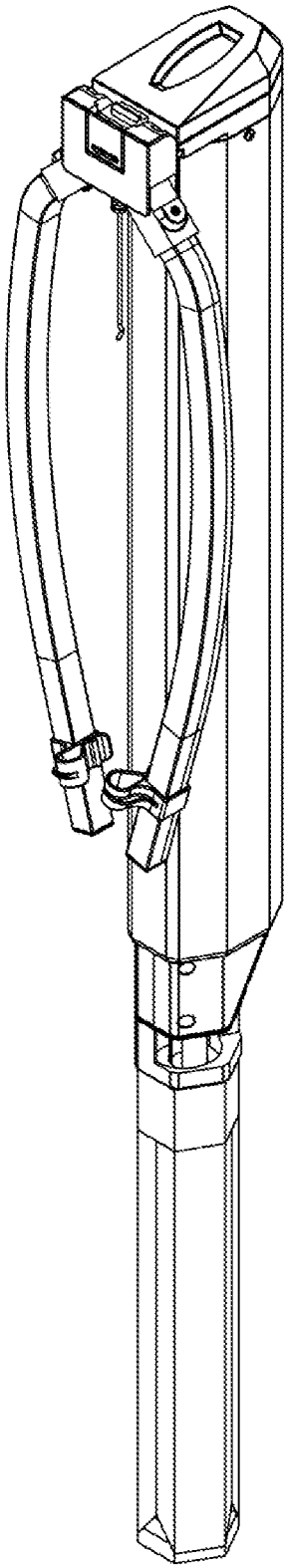
FIG. 1 is an isometric perspective view of a main body of a remote-controlled collapsible valet stand in a collapsed configuration, as contemplated by the present disclosure.
Figure 2:
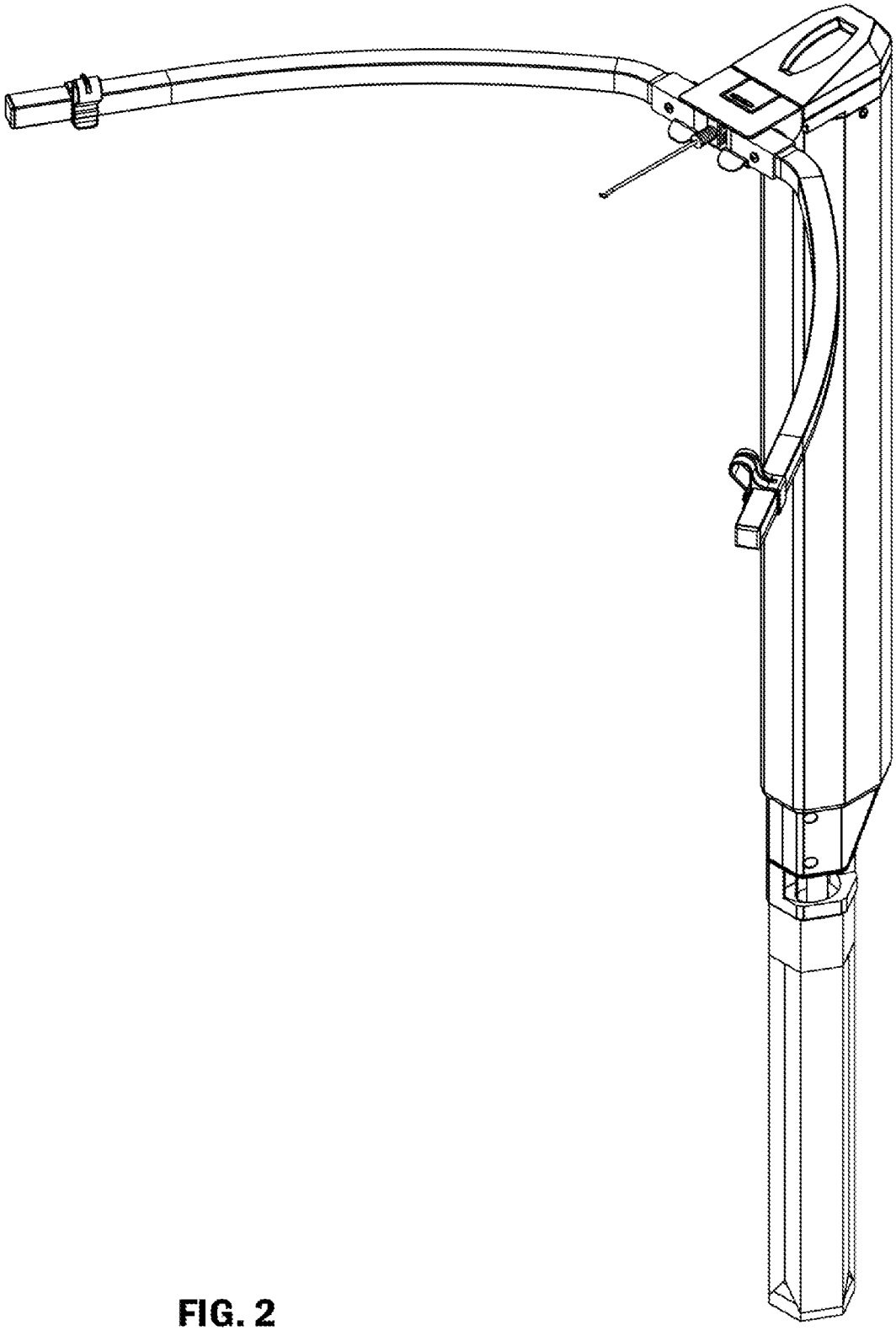
FIG. 2 is an isometric perspective view of a main body of a remote-controlled collapsible valet stand in a collapsed configuration with the plurality of arms deployed, as contemplated by the present disclosure.
Figure 3:
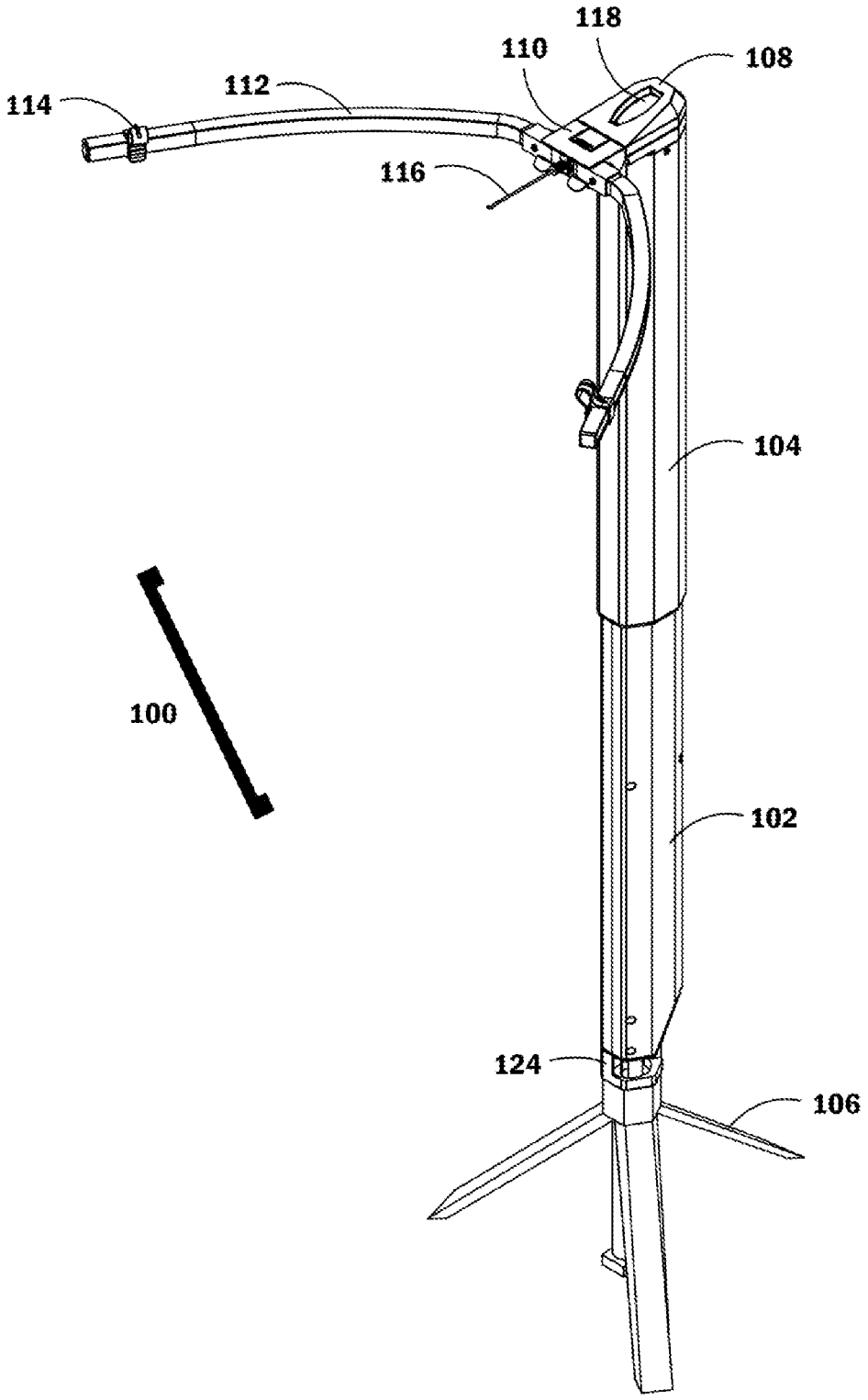
FIG. 3 is an isometric perspective view of a main body of a remote-controlled collapsible valet stand in a fully deployed and extended configuration, as contemplated by the present disclosure.
Figure 4:
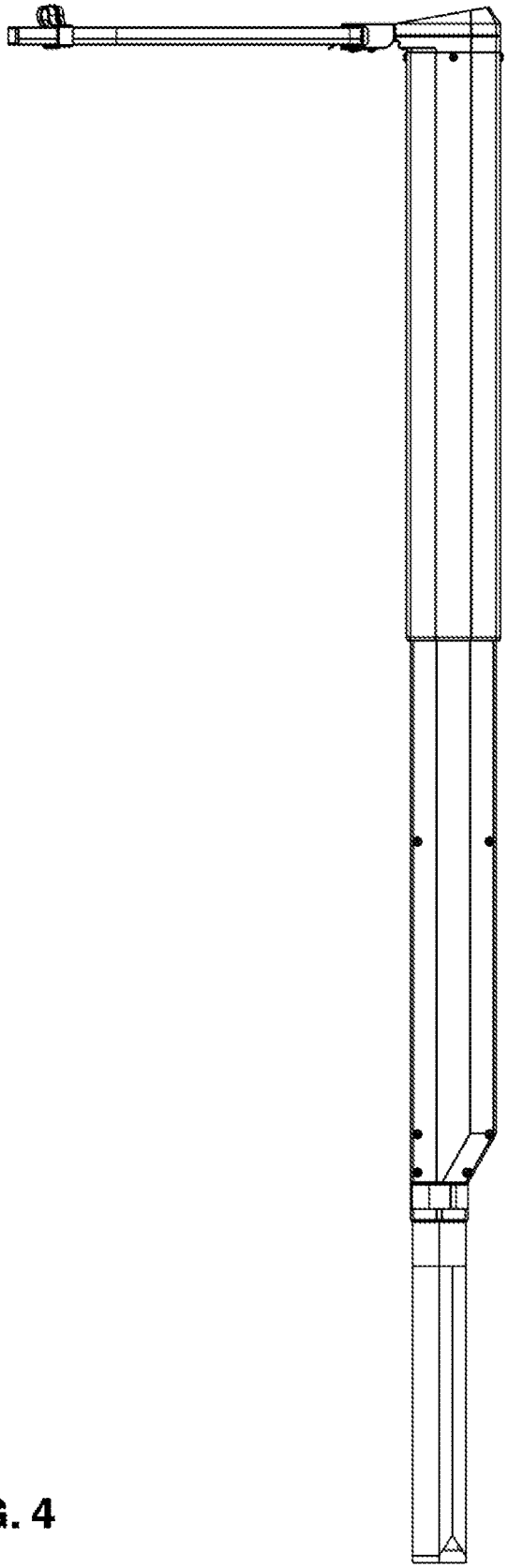
FIG. 4 is a left side elevation view of a main body of a remote-controlled collapsible valet stand in an extended configuration with the plurality of arms deployed, as contemplated by the present disclosure.
Figure 5:
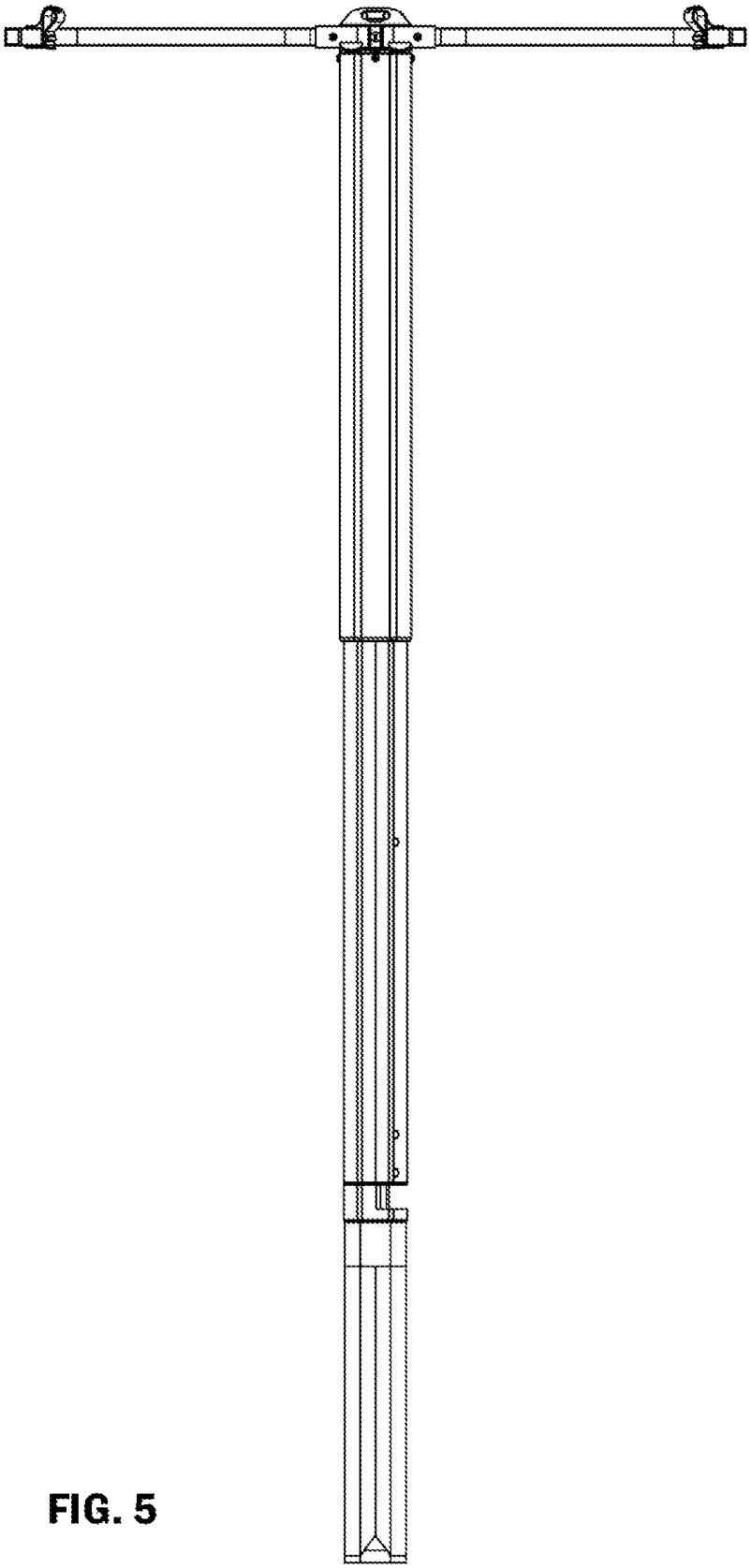
FIG. 5 is a front elevation view of a main body of a remote-controlled collapsible valet stand in an extended configuration with the plurality of arms deployed, as contemplated by the present disclosure.
Figure 6:
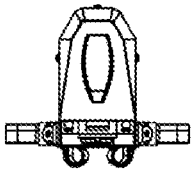
FIG. 6 is a top plan view of a remote-controlled collapsible valet stand in a collapsed configuration, as contemplated by the present disclosure.
Figure 7:
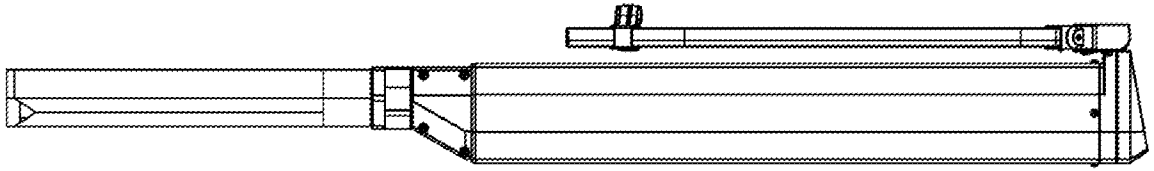
FIG. 7 is a left side elevation view of a main body of a remote-controlled collapsible valet stand in a collapsed configuration, as contemplated by the present disclosure.
Figure 8:
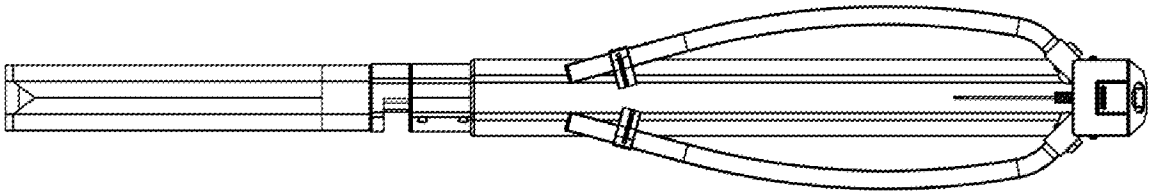
FIG. 8 is a front elevation view of a main body of a remote-controlled collapsible valet stand in a collapsed configuration, as contemplated by the present disclosure.
Figure 9:
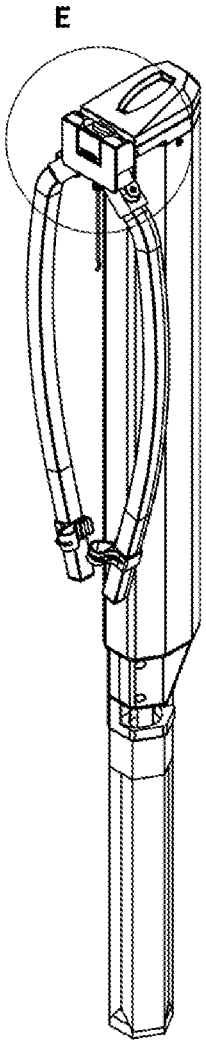
FIG. 9 is an isometric perspective view of a main body of a remote-controlled collapsible valet stand in a collapsed configuration, as contemplated by the present disclosure.
Figure 10:
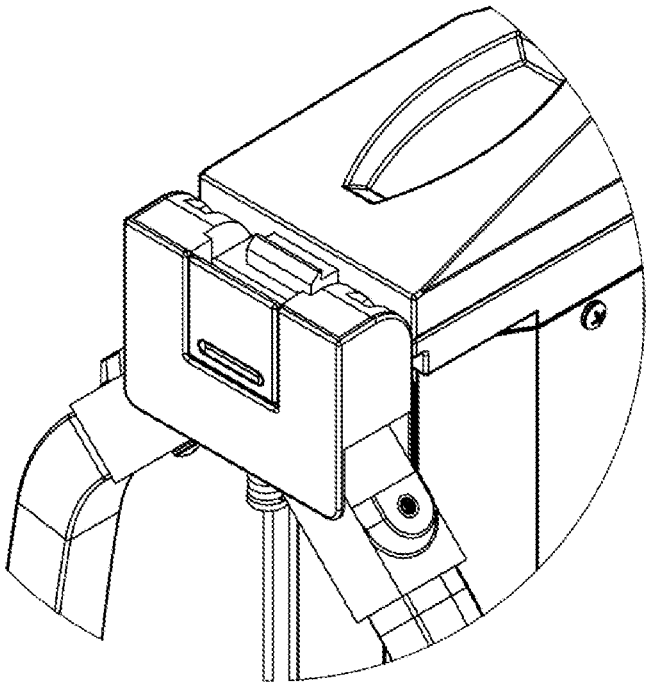
FIG. 10 is an isometric closeup view of Area E of FIG. 9 showing the atlas and pivot of a remote-controlled collapsible valet stand, as contemplated by the present disclosure.
Figure 11:
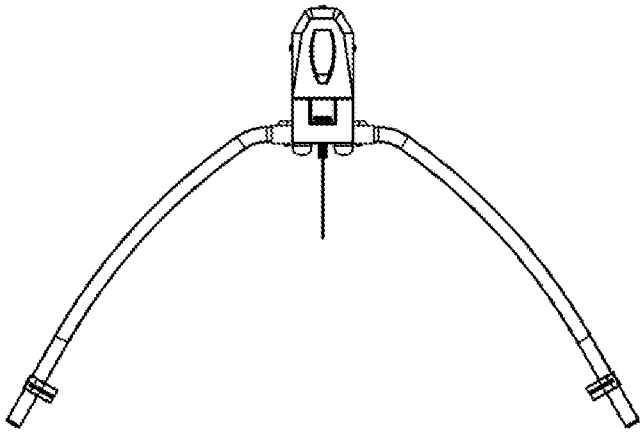
FIG. 11 is a top plan view of a remote-controlled collapsible valet stand with the plurality of arms deployed, as contemplated by the present disclosure.
Figure 12:
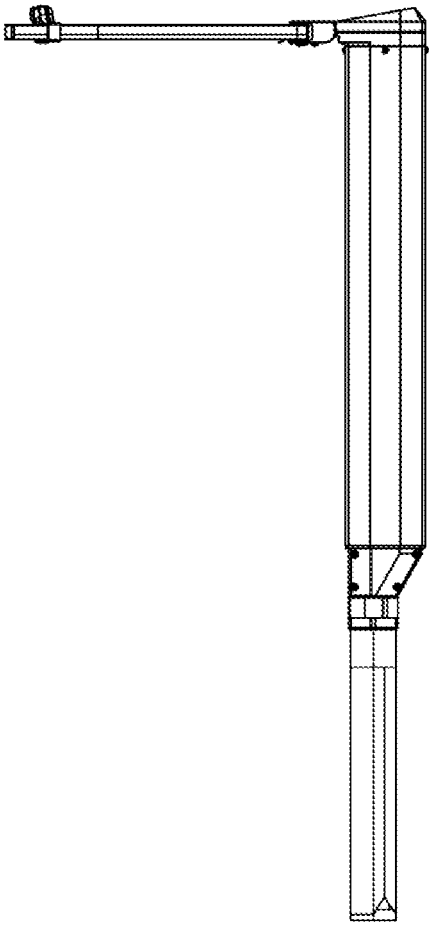
FIG. 12 is a left side elevation view of a main body of a remote-controlled collapsible valet stand in a collapsed configuration with the plurality of arms deployed, as contemplated by the present disclosure.
Figure 13:
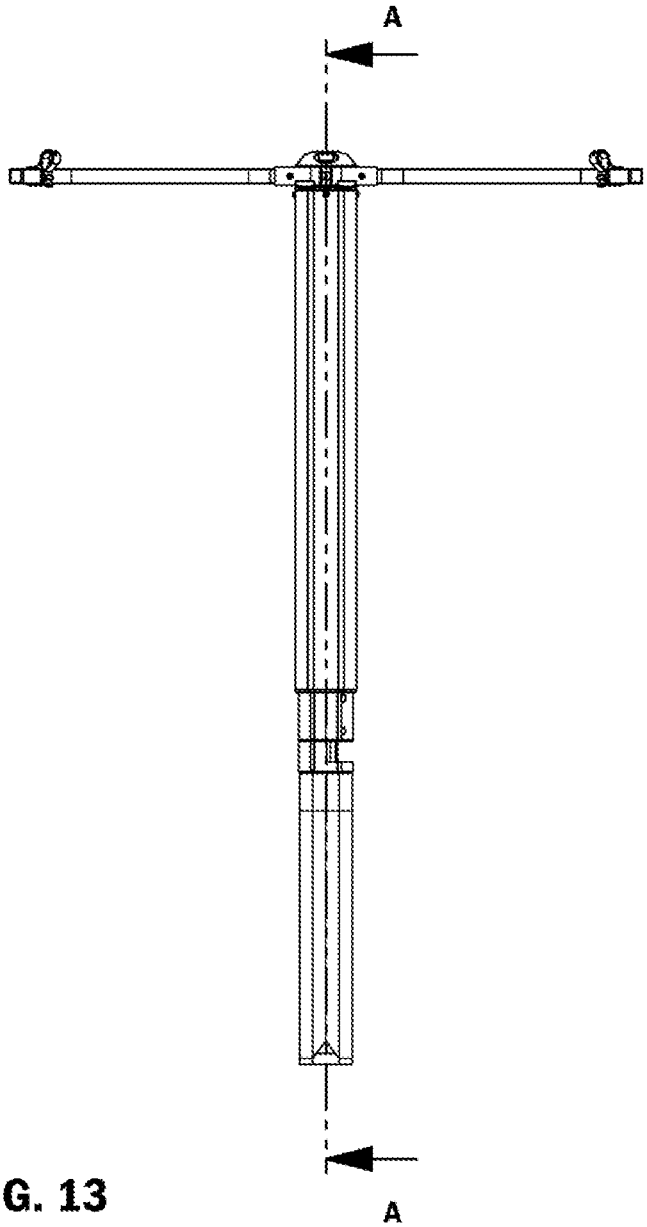
FIG. 13 is a front elevation view of a main body of a remote-controlled collapsible valet stand in a collapsed configuration with the plurality of arms deployed, as contemplated by the present disclosure.
Figure 14:
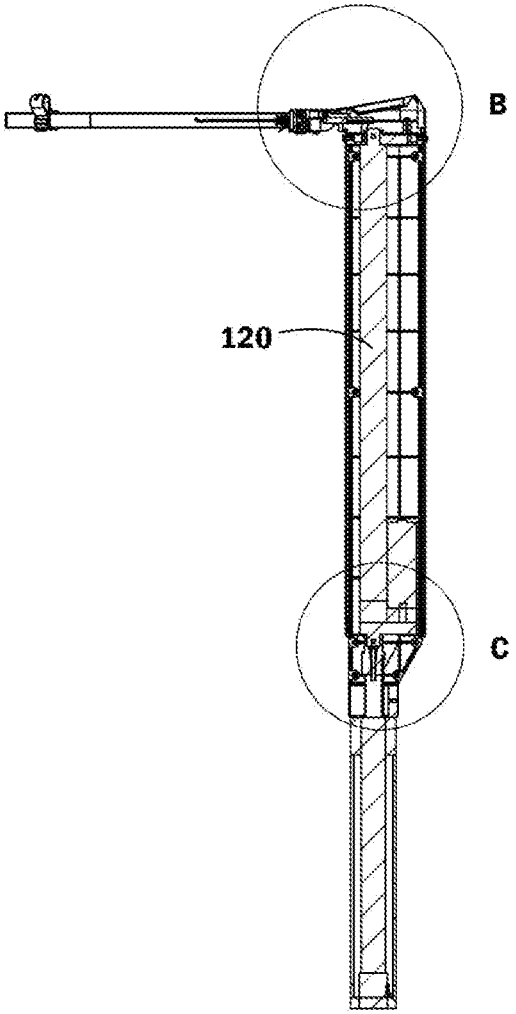
FIG. 14 is a cross-sectional view along Line A of FIG. 13 of a main body of a remote-controlled collapsible valet stand in a collapsed configuration with the plurality of arms deployed, as contemplated by the present disclosure.
Figure 15:
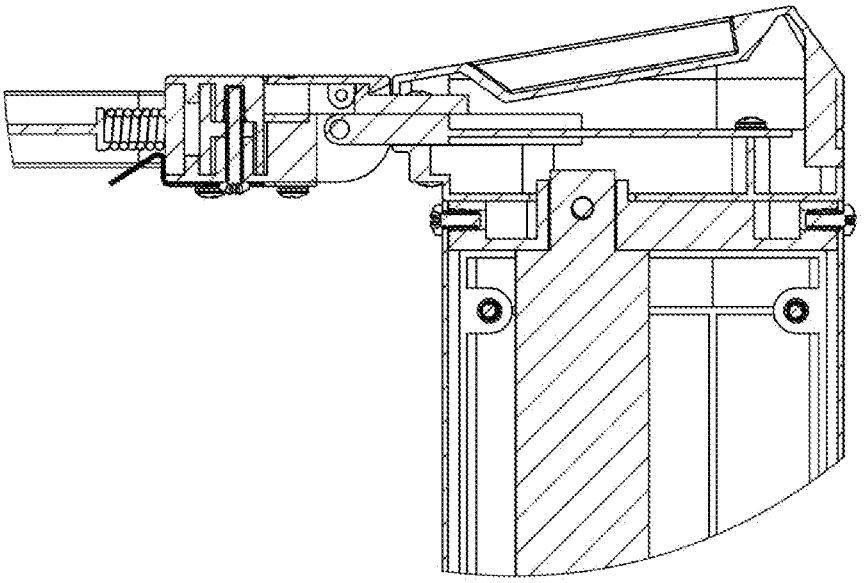
FIG. 15 is a cross-sectional closeup view of Area B of FIG. 15 showing the atlas and pivot of a remote-controlled collapsible valet stand, as contemplated by the present disclosure.
Figure 16:
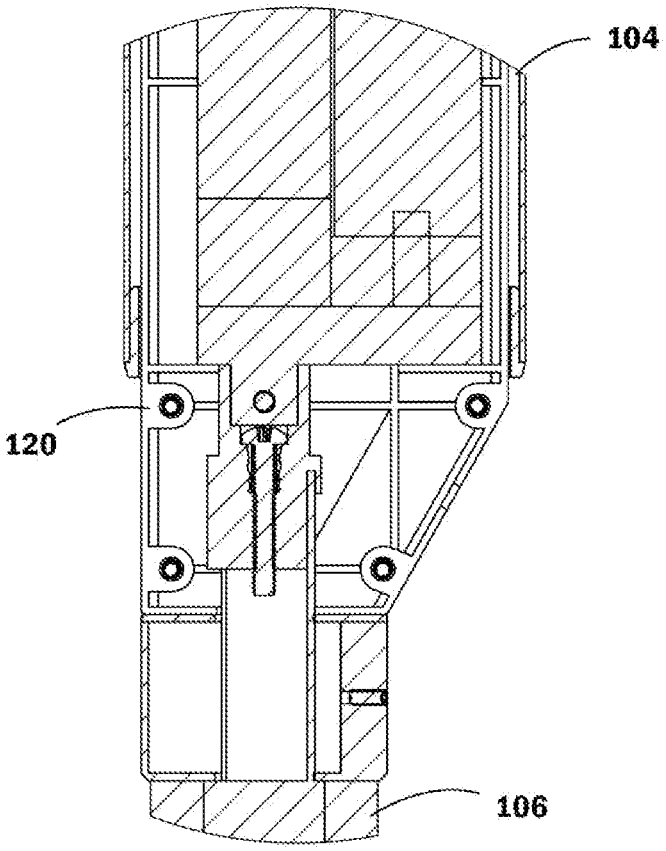
FIG. 16 is a cross-sectional closeup view of Area C of FIG. 15 showing the linear actuator and height adjuster of a remote-controlled collapsible valet stand, as contemplated by the present disclosure.
Figure 17:
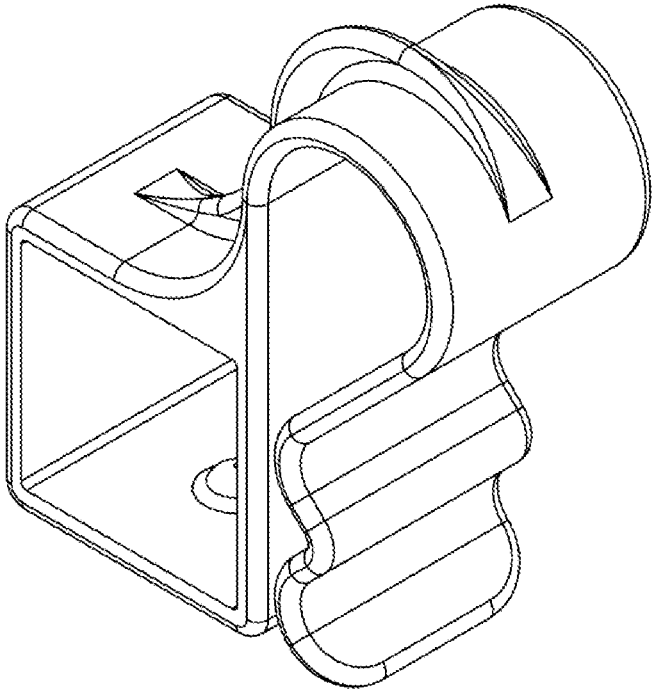
FIG. 17 is an isometric perspective view of one of a plurality of clips of a remote-controlled collapsible valet stand, as contemplated by the present disclosure.
Figure 18:
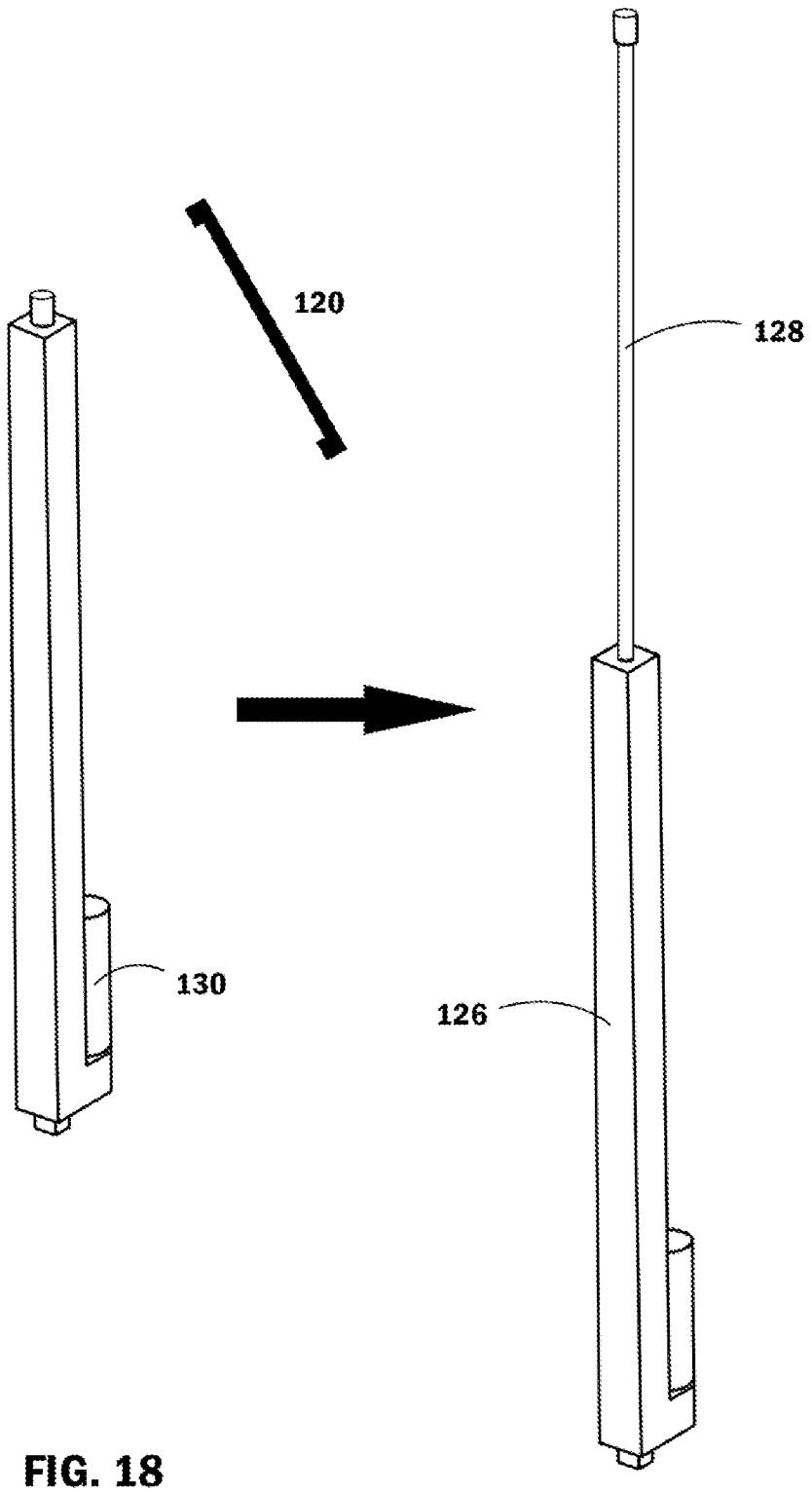
FIG. 18 is an isometric perspective view of the linear actuator of a remote-controlled collapsible valet stand, as contemplated by the present disclosure.
Figure 19:
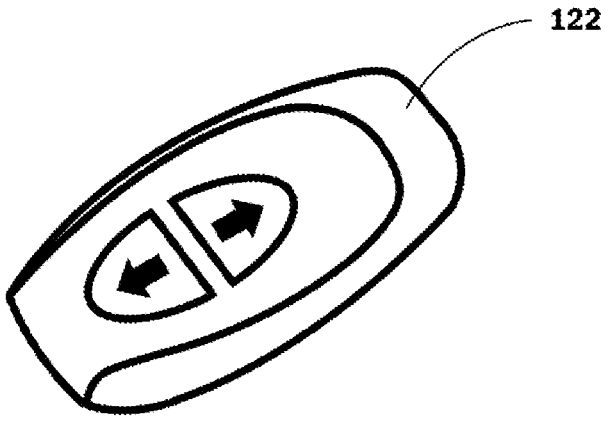
FIG. 19 is an isometric perspective view of a remote of a remote-controlled collapsible valet stand, as contemplated by the present disclosure.

The illustrations of FIGS. 1-19 illustrate a remote-controlled collapsible valet stand, as contemplated by the present disclosure. The device may comprise, generally, a main body 100 having a structural base, a clothes hanging mechanism, and a length adjusting mechanism.

The structural base of the main body 100 may comprise any base appropriate for maintaining the device in an upright orientation. By way of example, the structural base may comprise a square or rounded plate, a plurality of legs, a tripod, or any other appropriate design. In one embodiment the structural base may comprise a tripod base 106 having a plurality of deployable legs or feet. In this way the tripod base 106 may be deployed to maintain the device in an upright position and reversibly retracted for storage.

The clothes hanging mechanism of the main body 100 may comprise any hanger appropriate for hanging an article of clothing therefrom, especially a coat, button-down shirt, or the like. By way of example, the clothes hanging mechanism may comprise a clothes hanger, a plurality of dowels, a plurality of hooks, or any other appropriate design. In one embodiment the clothes hanging mechanism may comprise a plurality of arms 112 having an articulating mechanism and a plurality of clips 114. In this way the plurality of arms 112 may be deployed hang an article of clothing therefrom and reversibly retracted for storage. The plurality of clips 114 may comprise any clips appropriate for holding an article of clothing and releasing the article of clothing when it is pulled away. In this way a user may hang an article of clothing from the plurality of clips 114 and remove the clothing from the clips by pulling on it.

The length adjusting mechanism of the main body 100 may comprise any mechanism appropriate for reversibly increasing the distance between the structural base and the clothes hanging mechanism. By way of example, the length adjusting mechanism may comprise a telescoping pole, a screw lift, a hydraulic lift, or any other appropriate design. In one embodiment the length adjusting mechanism may comprise a linear actuator 120 having a pushrod housing 126, a pushrod 128, an electric motor 130, and a remote 122. The linear actuator 120 may be powered by any appropriate component such as, for example, a plurality of batteries or a standard power adapter. In this way the linear actuator 120 may be activated to increase the length between the structural base and the clothes hanging mechanism, resulting in the raising of an article of clothing attached to the clothes hanging mechanism.

To begin using the device a user may first attach an article of clothing to the plurality of clips 114 so that the clothing is being held open facing the user. The user may then back up to the open article of clothing and insert their hands into the respective sleeves of the clothing. The user may then activate the linear actuator 120 by any appropriate trigger mechanism such as, for example, manipulating the remote 122 or manipulating a start button. The linear actuator 120 may then extend and raise the clothes hanging mechanism relative to the structural base, thus raising the article of clothing up the arms of the user. Once the clothes hanging mechanism is raised high enough the clothing is being worn by the user. The user may then step away from the remote-controlled collapsible valet stand to disconnect the article of clothing from the plurality of clips 114.

In one embodiment the remote-controlled collapsible valet stand may further comprise a lower cowling 102 and an upper cowling 104. The lower cowling 102 and upper cowling 104 may comprise any housing appropriate to cover and protect the internal mechanisms of the device. The upper cowling 104 may comprise an identical though slightly larger cross-section to the lower cowling 102 so that one cowling telescopes into the other as the device is shortened.

In one embodiment the remote-controlled collapsible valet stand may further comprise an atlas 108 having a remote holder 118. The atlas 108 may comprise any structural component appropriate for attaching the linear actuator 120 or the upper cowling 104 to the plurality of arms 114. The remote holder 118 may comprise any appropriate cut out, divot, or indent appropriate for receiving and storing the remote 122.

In one embodiment the remote-controlled collapsible valet stand may further comprise a pivot 110 having a spring rod 116. The pivot 112 may comprise any structural component appropriate for attaching the atlas 108 to the plurality of arms 112 and allowing the plurality of arms 112 to be reversibly articulated between a collapsed orientation and an extended orientation. The pivot 112 may allow for the plurality of arms 112 to be articulated from a horizontal orientation to a vertical orientation by comprising a vertical pivoting hinge or similar component, and may allow for the plurality of arms 112 to be articulated from an extended orientation to a collapsed orientation by comprising a horizontal pivoting hinge or similar component. The spring rod 116 may comprise any spring-loaded rod having a hook for assisting in holding up an article of clothing held within the device.

In one embodiment the remote-controlled collapsible valet stand may further comprise a height adjuster 124. The height adjuster 124 may comprise any structural component appropriate for increasing or decreasing the initial or final overall height of the device. By way of example, the height adjuster 124 may comprise a telescoping pole, a screw lift, a hydraulic lift, or any other appropriate design. In this way the device may be adjusted for users of different heights.

In one embodiment the remote-controlled collapsible valet stand may further comprise a proximity sensor. The proximity sensor may comprise any sensor appropriate for detecting the presence of a user and automatically triggering the activation of the linear actuator 120. By way of example, the proximity sensor may comprise a laser, a sound receiver, a pressure sensor, or other similar device. A laser sensor, for example, may be installed at the distal end of either of the plurality of arms 112 such that a user breaks the sensor when backing into the device. A sound receiver, for example, may be installed within the device to receive and respond to an audible start command. A pressure sensor, for example, may be a foot pedal that a user may press to activate the device.

In one embodiment the remote-controlled collapsible valet stand may further comprise an audiovisual alarm. The audiovisual alarm may comprise any alarm appropriate for indicating a status to a user. By way of example, the audiovisual alarm may comprise a plurality of lights, a plurality of speakers, a combination of lights and speakers, or other similar device. The audiovisual alarm may indicate to a user an upper or lower range of travel of the device, that the device is powered, or any other appropriate indication.

In one embodiment the remote-controlled collapsible valet stand may further comprise a proprietary software. The speed and action of the device may be controlled electronically, and a proprietary software may be implemented to program or command when the linear actuator 120 is activated, when the device is extended or collapsed, how tall the device stands, or any other appropriate parameter. By this programming the device can be instructed when to start and stop, how much force to output, and when to fail safe in the event of an emergency or in response to specific parameters.

In one embodiment the remote-controlled collapsible valet stand may further comprise a display device. The display device may comprise any appropriate digital display or interactive display, such as a high-definition liquid crystal display or a touch screen. A plurality of input devices may also be attached to the display device allowing a user to interact with the display device or the system. Such plurality of input devices may comprise, for example, a keyboard and mouse combination, a microphone, a facial recognition or gesture recognition camera, or any other appropriate input.

The remote-controlled collapsible valet stand may be substantially assembled by any appropriate mechanism known in the art. By way of example, the various components of the device may be attached to one another, as contemplated by the present disclosure, by screwing, gluing, welding, adhering, interlocking, clasping, binding, nailing, or any other appropriate mechanism.

The remote-controlled collapsible valet stand may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the remote-controlled collapsible valet stand may be substantially constructed of one or more materials of steel, aluminum, brass, fiberglass, carbon fiber, plastic, acrylic, polycarbonate, polyester, nylon, denim, cotton, silicone, or combinations thereof. In some embodiments the various components of the device may be coated, lined, or otherwise insulated to prevent contamination of the device. In one embodiment the material of construction may vary from one component to the next within the system.

In one embodiment the remote-controlled collapsible valet stand may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A remote-controlled collapsible valet stand, comprising:

a structural base;

a clothes hanging mechanism;

a length adjusting mechanism;

a trigger;

an atlas; and a pivot;

wherein said structural base comprises a device base;

wherein said clothes hanging mechanism comprises a clothes hanger;

wherein said length adjusting mechanism comprises a reversibly extendable component;

wherein said length adjusting mechanism is attached vertically to said structural base;

wherein said clothes hanging mechanism is attached to a top of said length adjusting mechanism;

wherein said trigger activates said length adjusting mechanism;

wherein said activation of said length adjusting mechanism reversibly increases a vertical distance between said structural base and said clothes hanging mechanism;

wherein said clothes hanging mechanism further comprises a plurality of arms;

wherein said length adjusting mechanism comprises a linear actuator;

wherein said plurality of arms are articulably attached to said pivot;

wherein said pivot is articulably attached to said atlas;

wherein said atlas is attached to a top of said linear actuator.

2. The remote-controlled collapsible valet stand of claim 1, further comprising:

a height adjuster;

wherein said height adjuster is installed between said structural base and said atlas; and wherein said height adjuster adjusts a starting height of said linear actuator.

3. The remote-controlled collapsible valet stand of claim 2, wherein one each of said plurality of arms further comprises one each of a plurality of clips.

4. The remote-controlled collapsible valet stand of claim 3, further comprising:

a spring rod.

5. The remote-controlled collapsible valet stand of claim 4, further comprising:

a lower cowling; and an upper cowling.

6. The remote-controlled collapsible valet stand of claim 4, wherein said trigger comprises a remote.

7. The remote-controlled collapsible valet stand of claim 6,
wherein said atlas further comprises a remote holder.

8. The remote-controlled collapsible valet stand of claim 4,
wherein said trigger comprises a proximity sensor.

9. The remote-controlled collapsible valet stand of claim 4, further comprising:
an audiovisual alarm.

10. The remote-controlled collapsible valet stand of claim 4, further comprising:
a proprietary software.

11. The remote-controlled collapsible valet stand of claim 4, further comprising:
a display device.

12. The remote-controlled collapsible valet stand of claim 4,
wherein said structural base comprises a tripod base.

* * * * *